United States Patent [19]

Anderson

[11] 4,184,660

[45] Jan. 22, 1980

[54] SHELF AND ROD WALL BRACKET

[75] Inventor: William J. Anderson, Taylorsville, Miss.

[73] Assignee: Anderson Metal Products Corp., Taylorsville, Miss.

[21] Appl. No.: 951,409

[22] Filed: Oct. 16, 1978

[51] Int. Cl.[2] ..... A47G 29/02

[52] U.S. Cl. ..... 248/235; 108/29; 211/123

[58] Field of Search ..... 248/250, 235; 211/123, 211/90; 108/29, 31

[56] References Cited

U.S. PATENT DOCUMENTS

| | | | |
|---|---|---|---|
| D. 189,918 | 3/1961 | Nordenson | 211/90 X |
| 1,961,728 | 6/1934 | Arnest et al. | 248/DIG. 6 |
| 2,624,468 | 1/1953 | McCauley | 108/29 UX |
| 3,113,678 | 12/1963 | Dickinson et al. | 108/27 UX |
| 3,220,363 | 11/1965 | Gingher | 108/29 UX |
| 3,284,040 | 11/1966 | Marontate | 211/90 X |
| 3,288,308 | 11/1966 | Gingher | 211/123 |
| 3,357,374 | 12/1967 | Smith et al. | 108/29 |
| 3,471,112 | 10/1969 | McDonald et al. | 248/250 X |
| 3,702,591 | 11/1972 | Banse | 108/31 |
| 3,865,336 | 2/1975 | Robertson | 211/123 X |

FOREIGN PATENT DOCUMENTS

| | | | |
|---|---|---|---|
| 638333 | 3/1962 | Canada | 211/90 |

*Primary Examiner*—J. Franklin Foss

*Attorney, Agent, or Firm*—Darbo & Vandenburgh

[57] ABSTRACT

A unitary bracket for both a closet shelf and rod has a substantially horizontal shelf support and a concave rod support, both projecting from a sidewall which is attached to a wall of the building structure. A locking tab projects from the sidewall and prevents unintended upward movement of a clothes rod. In addition, there is provided a breakaway shelf-retaining tab to hold a shelf of limited size in place while permitting use of a wider shelf which extends beyond the broken-away tab. Integral gussets further increase the strength of the wall bracket.

1 Claim, 3 Drawing Figures

SHELF AND ROD WALL BRACKET

SUMMARY OF THE INVENTION

The present invention relates to wall brackets for mounting both a shelf and a closet rod. The brackets are made of a single piece of material, thus cutting construction cost and promoting quick installation. In the preferred embodiment, plastic is used to construct the brackets, providing for an adequately strong and clean-looking device, while at the same time eliminating dangerous sharp edges prevalent in sheet metal formed brackets.

DESCRIPTION OF SPECIFIC EMBODIMENT

Figure 1:
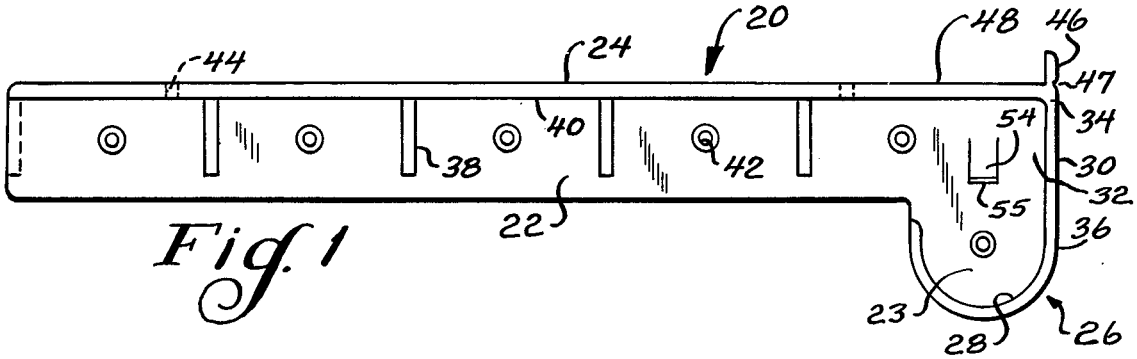
FIG. 1 is a side view of a right hand wall bracket embodying the invention, including breakaway shelf-retaining tab.

Shown in FIG. 1, the invention consists of a wall bracket 20 for securely holding both a shelf and a closet rod simultaneously, and is integral in construction, being made of a single body of material. It is known to make wall brackets which hold both a shelf and rod; however, these devices have heretofore been made from more than one part, thus requiring construction labor costs and time, either in the factory or in the field. The shelf and rod wall bracket 20 includes an elongate vertical sidewall 22 which is used to attach the bracket to a wall on the right side of a closet, and, more importantly for purposes of the invention, to increase the strength of both the shelf support 24 and the rod support 26. The shelf support 24 is substantially horizontal, the length of the sidewall 22, and projects from the sidewall.

The rod support 26 also projects from the sidewall. It is located at the forward end 32 of the bracket and has a concave top surface 28 for receiving one end of a substantially cylindrical clothes rod. The rod support 26 projects from, and is integral with and supported by the sidewall 22. The sidewall maintains the shelf support 24 and rod support 26 in a substantially stable relationship, being integral therewith.

In the preferred embodiment a vertical frontispiece 30 extends from the sidewall 22 at its forward end 32. The top 34 of the frontispiece merges into the horizontal shelf support 24. The bottom 36 of the frontispiece 30 merges into the rod support 26.

The shelf support 24 is strengthened in its supporting function by a plurality of spaced gussets 38 which are integrally molded or cast so as to project from both the bottom side 40 of the shelf support 24 and the sidewall 22, extending between these structural parts of the bracket, thus greatly increasing the ability of the shelf support to uphold a loaded closet shelf.

Figure 2:
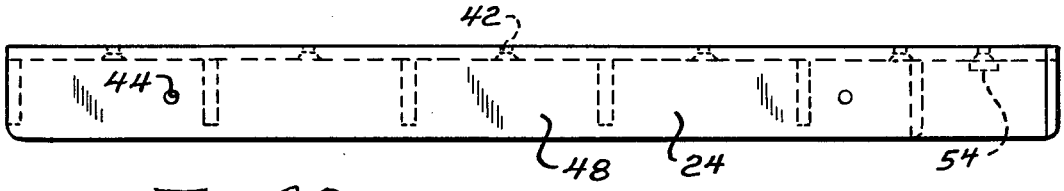
FIG. 2 is a top elevational view of the wall bracket.
Figure 3:
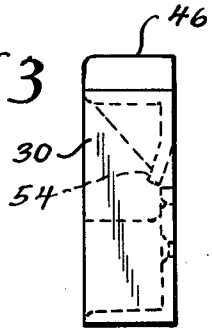
FIG. 3 is a front view thereof.

FIGS. 2 and 3 further show the unitary nature of the invention. The sidewall 22 serves as a base for the shelf support 24 and rod support 26, frontispiece 30 also being supported by the sidewall and, in turn, strengthening the support of both shelf and rod supports. When downward force is applied to the rod support 26 by a loaded closet rod, the rod support maintains its position because the downward force is partially transferred to the rest of the wall bracket 20 through several structural parts, especially through the frontispiece and shelf support which are indirectly and directly connected to the gussets 38 and directly by sidewall 22, especially the portion 23 which is integral with rod support 26.

Because of its unitary construction, the wall bracket is economical to manufacture. One-piece construction also naturally provides for weight distribution, thereby increasing the maximum load permitted on the wall bracket.

The wall bracket 20 is installed by screws or other suitable fastening means through a plurality of spaced holes 42 provided in the sidewall 22. In addition, a plurality of holes 44 may be provided in the shelf support 24 so as to securely fasten a shelf thereto by the use of srews or other suitable means.

In the preferred embodiment, the wall bracket 20 includes a breakaway shelf-retaining tab 46 which projects vertically from the upper surface 48 of the shelf support 24 at the forward end thereof. The retaining tab 46 effectively limits forward motion of a shelf resting on the shelf support, thus promoting stability of a shelf of accommodatable width even when the shelf is not securely fastened by the screws through the shelf support holes 44.

In addition, the retaining tab 46 enhances the ease of installation of the bracket. A shelf may often be desired which is wider than the supporting wall bracket. Due to the strength of the bracket 20 and the means provided for fastening it to a building wall, an oversize shelf may be used safely. Such a shelf can be mounted in either one of three ways: (1) the bracket may be mounted at a distance from the rear wall of the building structure as required for the front edge of the shelf to abut the tabs 46; (2) the breakaway tabs may be broken off at the weakened section 47 at its base and the shelf permitted to extend forwardly from the bracket, or (3) the arrangement of (2) with the bracket mounted at a distance from the rear wall as in (1).

Spring latching tab 54 is provided so as to prevent unintended upward movement of a closet rod nested in position in the rod support 26. The latching tab 54 projects downwardly and outwardly from the sidewall 22 at a point above the center of the rod support, the free end 55 being located at a distance from the center approximately equal to the radius of curvature of the surface 28. As the closet rod is being lowered into position in the support 26, the latching tab 54 bends out of the way, then snaps out to normal position when the rod is in place to prevent lifting of the rod out of its support.

It will be understood that the brackets must be made and supplied in pairs, the left hand bracket of the pair being a mirror image of the right hand bracket shown in the drawing. As already noted, the brackets may advantageously be produced by injection molding of plastic material. They may also be produced by, for example, zinc or aluminum die casting.

I claim:

1. A unitary wall bracket for supporting both a shelf and a rod simultaneously, comprising:

a. An elongate sidewall having a top edge and a forward end;

b. an elongate shelf support extending integrally from said top edge of said sidewall at a right angle thereto;

c. a rod support projecting integrally from said forward end of said sidewall at a right angle thereto, said rod support having an upwardly opening arcuate surface portion for receiving one end of a clothes rod comforming thereto;

d. a frontispiece which projects at a right angle from the forward end of the sidewall and extends between and is connected with the rod support and shelf support, said frontispiece being integral with said rod support and shelf support and sidewall to strengthen the associated structure; D e. a spring latching tab including a free end thereof, the latching tab projecting downwardly and outwardly from the sidewall such that when the latching tab conforms with the sidewall, the free end is located along the arc defined by the radius of curvature of the rod support surface and directly above the center of the arc, so that the latching tab limits upward movement of a rod in the wall bracket by pressing against an upper surface of the rod;

f. a plurality of spaced gussets extending between the sidewall and the shelf support for enhanced support of the latter; and g. a break-away shelf retaining tab projecting vertically from the upper surface of the shelf support at the forward end of the bracket, said retaining tab effectively limiting forward motion of a shelf resting on the shelf support, wherein said wall bracket is constructed of plastic into a single, continuous piece of material.

* * * * *